US011091301B2

(12) United States Patent
Fretta

(10) Patent No.: US 11,091,301 B2
(45) Date of Patent: Aug. 17, 2021

(54) CONTAINER EQUIPPED WITH TAMPER EVIDENT CLOSURE

(71) Applicant: Roberto Fretta, Givoletto (IT)

(72) Inventor: Roberto Fretta, Givoletto (IT)

( * ) Notice: Subject to any disclaimer, the term of this patent is extended or adjusted under 35 U.S.C. 154(b) by 25 days.

(21) Appl. No.: 16/613,492

(22) PCT Filed: Apr. 24, 2018

(86) PCT No.: PCT/IT2018/000056
§ 371 (c)(1),
(2) Date: Nov. 14, 2019

(87) PCT Pub. No.: WO2018/211537
PCT Pub. Date: Nov. 22, 2018

(65) Prior Publication Data

US 2020/0165039 A1 May 28, 2020

(30) Foreign Application Priority Data

May 15, 2017 (IT) ..... 102017000044689

(51) Int. Cl.
*B65D 43/02* (2006.01)

(52) U.S. Cl.
CPC ..... *B65D 43/0243* (2013.01); *B65D 2543/00175* (2013.01); *B65D 2543/00296* (2013.01); *B65D 2543/00462* (2013.01); *B65D 2543/00657* (2013.01); *B65D 2543/00685* (2013.01); *B65D 2543/00768* (2013.01); *B65D 2543/00796* (2013.01); *B65D 2543/00842* (2013.01)

(58) Field of Classification Search
CPC ..... B65D 43/0243; B65D 43/0237; B65D 2543/00768; B65D 43/0249
See application file for complete search history.

(56) References Cited

U.S. PATENT DOCUMENTS

| | | | | |
|---|---|---|---|---|
| 5,437,386 | A | 8/1995 | Von Holdt | |
| 2009/0120942 | A1* | 5/2009 | Vovan | B65D 43/0249 220/574.1 |
| 2013/0320015 | A1 | 12/2013 | Dyble et al. | |

FOREIGN PATENT DOCUMENTS

| | | | |
|---|---|---|---|
| EP | 3064446 | A1 | 9/2016 |
| GB | 2278838 | A | 12/1994 |

* cited by examiner

*Primary Examiner* — Jeffrey R Allen
(74) *Attorney, Agent, or Firm* — Maschoff Brennan

(57) ABSTRACT

A container is described comprising: a base comprising a mouth, a first edge obtained around the mouth and a second edge connected to the first edge by a lower wall; a cover capable of being closed again on the base, the cover comprising a base wall and an edge connected to the base wall and adapted to be assembled with interference on the first edge of the base; the lower wall further comprising a breaking line along which the separation of the second edge from the first edge and from the base is adapted to occur to allow opening the container providing evidence of the occurred opening, the first upper wall of the first edge having sizes greater than those of the opening of the edge, to assemble with interference the first edge of the base inside the edge of the cover when the cover is closed on the base.

6 Claims, 4 Drawing Sheets

CONTAINER EQUIPPED WITH TAMPER EVIDENT CLOSURE

BACKGROUND OF THE INVENTION

1) Field of the Invention

The present invention refers to a container equipped with a closure of the tamper evident type, in particular a container for packaging foodstuff and for exhibiting them in a sales point, equipped with a tamper evident closure adapted to point out the occurred first opening of the container, safeguarding the product contained inside it from possible counterfeiting.

2) Background Art

Several types of containers equipped with a closure of the tamper evident type are known in the art.

There remain anyway the need of making containers which are simply manufactured and equipped with a closure of the tamper evident type, which, in addition to point out the occurred first opening of the container, is anyway complex to be opened when the container is arranged on a shelf of a sales point, to counteract the removal of the product contained therein before its purchase.

Documents US-A1-2013/320015, US-A1-2009/120942, GB-A-2278838, U.S. Pat. No. 5,437,386 and EP-A1-3064446 disclose containers according to the preamble of claim 1.

SUMMARY OF THE INVENTION

Object of the present invention is solving the above prior art problems, by providing a container equipped with a closure of the tamper evident type which can me simply and economically manufactured, which counteracts the opening of the container before its purchase, for example when it is exhibited on a shelf of a sales point.

The above and other objects and advantages of the invention, as will appear from the following description, are obtained with a container equipped with a tamper evident closure as claimed in claim 1. Preferred embodiments and non-trivial variations of the present invention are the subject matter of the dependent claims.

It is intended that all enclosed claims are an integral part of the present description.

BRIEF DESCRIPTION OF THE DRAWINGS

The present invention will be better described by some preferred embodiments thereof, provided as a non-limiting example, with reference to the enclosed drawings, in which.

DETAILED DESCRIPTION OF PREFERRED EMBODIMENTS

Figure 1:
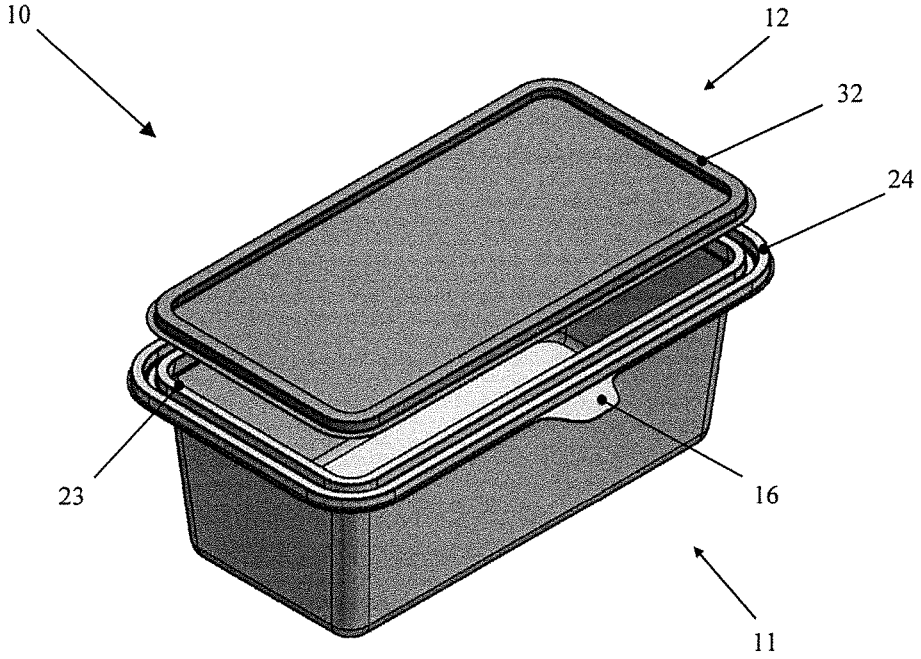
FIG. 1 is a perspective view of a first embodiment of a container according to the present invention.
Figure 2:
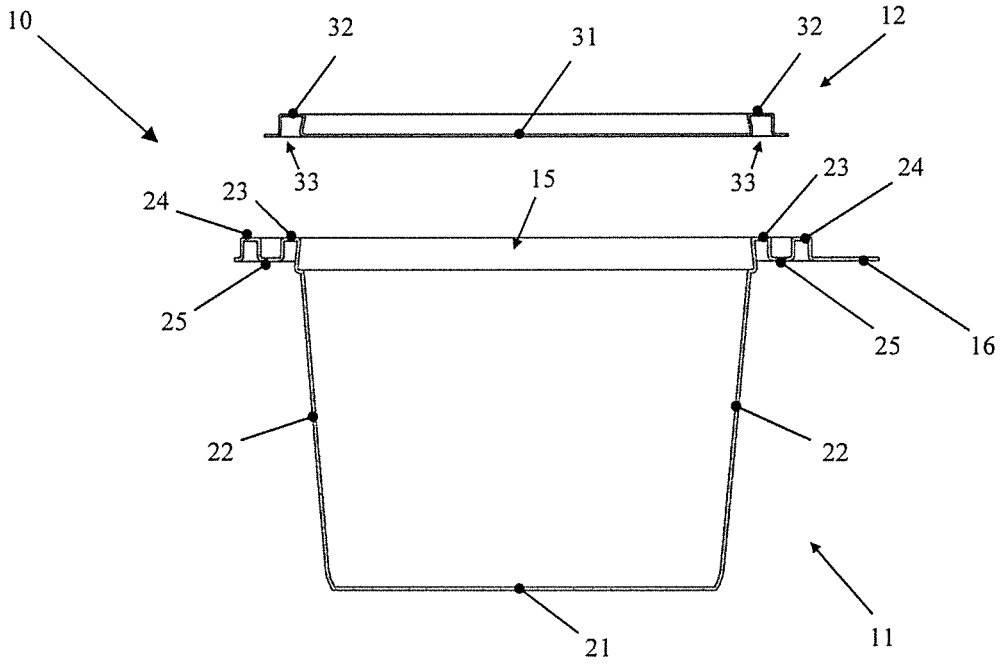
FIG. 2 is a side sectional view of a first embodiment of an open container according to the present invention.
Figure 3:
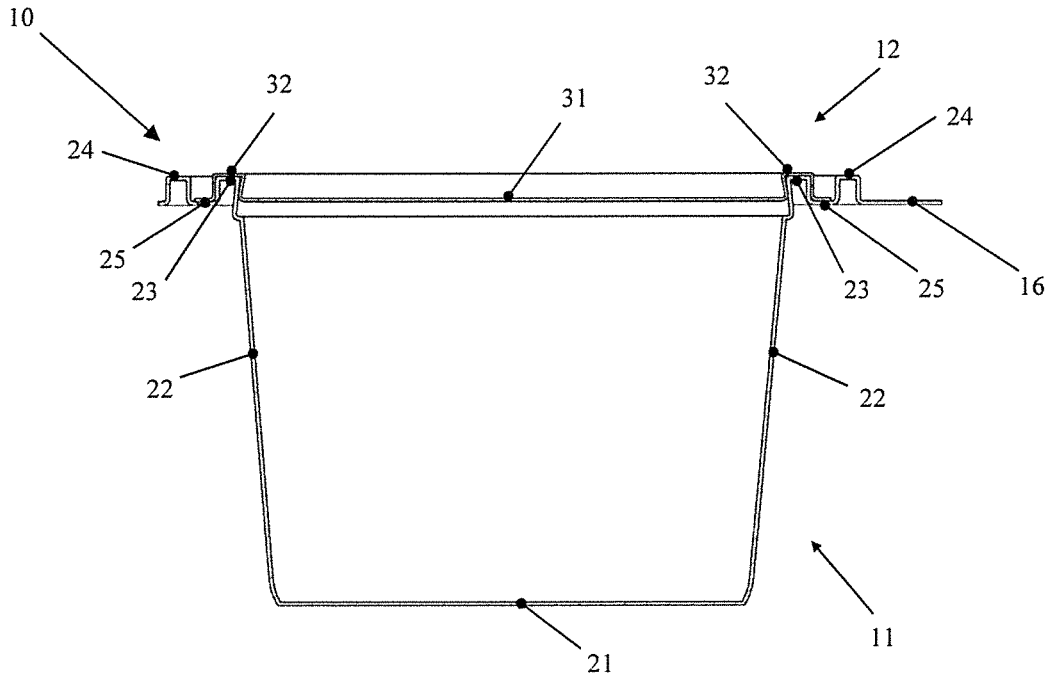
FIG. 3 is a side sectional view of a first embodiment of a closed container according to the present invention.

With reference to the Figures, a preferred embodiment of the container equipped with a closure of the tamper evident type of the present invention is shown and described. It will be immediately obvious that numerous variations and modifications (for example related to shape, sizes, arrangements and parts with equivalent functionality) can be made to what is described, without departing from the scope of the invention as appears from the enclosed claims.

The container 10 equipped with closure of the tamper evident type of the present invention comprises a base 11 and a cover 12 capable of being closed again on the base 11.

The base 11 comprises a base wall 21 connected to at least one side wall 22; preferably the base wall 21 has a polygonal shape, for example rectangular, squared, etc., or circular, oval, and the like, and the container 10 has substantially the shape of a parallelepiped, for example a polygonal (rectangular, squared, etc.) base, or of a cylinder, or a circular, oval shape, etc.; the at least one side wall 22 of the base 11 can be slanted or substantially perpendicular to the base wall 21.

Preferably, the base 11 and the cover 12 are made of plastic material, for example PET, APET, PS, PP, OPS.

The base 11 comprises a mouth 15 and a first edge 23 obtained around the mouth 15, in a preferred way connected to the side wall 22, more preferably connected to the upper end of the side wall 22; the base 11 further comprises a second edge 24 connected to the first edge 23 by a lower wall 25 on which a breaking line 26 is obtained, for example through an incision or with partial cuts, along which the separation of the second tamper evident edge 24 from the first edge 23 and from the base 11 is adapted to occur, to allow opening the container 10 providing evidence of the occurred opening; in a known way, the breaking line 26 can be rectilinear, zig-zag shaped, undulated or in other similar known shapes.

The cover 12 comprises a base wall 31 of the cover and an edge 32 connected to the base wall 31 and adapted to be assembled with interference on the first edge 23 of the base 11, preferably with the first edge 23 inserted inside the edge 32 through an opening 33 obtained at the base of the edge 32.

Figure 4:
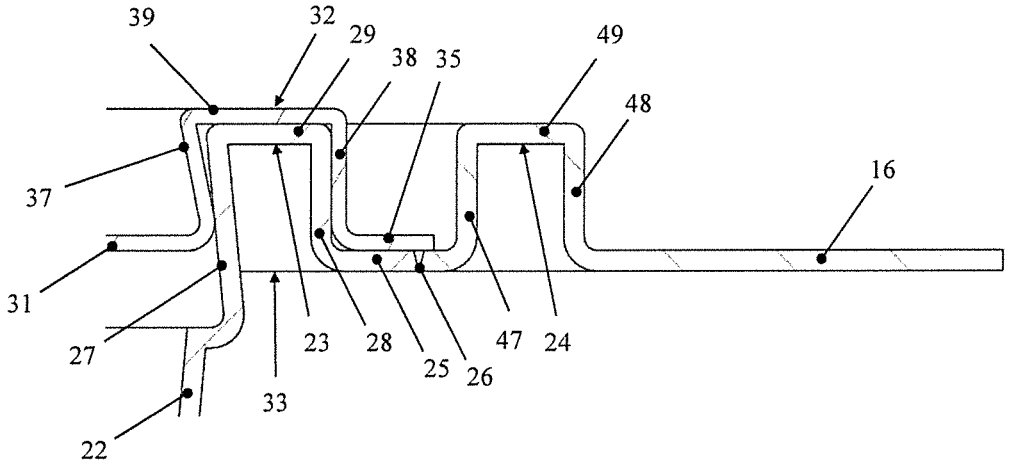
FIG. 4 is a side sectional view of an enlarged part of a first embodiment of a container according to the present invention.

Preferably, the first edge 23 and the second edge 24 form two small channels around the mouth 15 of the base 11 having a "U"-shaped section, shown in FIG. 4; the edge 32 forms a small channel around the cover 12, also having a "U"-shaped section, and the small channel formed by the first edge 23 is adapted to be assembled with interference inside the small channel formed by the edge 32 of the cover 12.

In a preferred way, the first edge 23 comprises a first internal wall 27, connected to the side wall 22 of the base 11, a first external wall 28, connected to the lower wall 25 and a first upper wall 29, connected to the first internal wall 27 and to the first external wall 28.

In a preferred way, the edge 32 of the cover 12 comprises an internal wall 37, connected to the base wall 31 of the cover 12, an external wall 38 and an upper wall 39 connected to the internal wall 37 and to the external wall 38.

The first upper wall 29 of the first edge 23 has sizes greater than those of the opening 33 of the edge 32, to assemble with interference the first edge 23 of the base 11 inside the edge 32 of the cover 12 when the cover 12 is closed on the base 11; in a preferred way, the first upper wall 29 of the first edge 23 is then in contact with the upper wall 39 of the edge 32, and the first internal wall 27 and external wall 28 of the first edge 23 are in contact respectively with the internal wall 37 and the external wall 38 of the edge 32.

The edge 32 of the cover 12 further comprises a lower wall 35 of the edge 32 connected to the external wall 38 and adapted to be assembled in contact with the lower wall 25 which connects the first edge 23 to the second edge 24 of the base 11, when the cover 12 is closed on the base 11.

In a preferred way, the second edge 24 comprises a second internal wall 47, connected to the lower wall 25, a second external wall 48 and a second upper wall 49, connected to the second internal wall 47 and to the second external wall 48.

When the cover 12 is closed on the base 11 with the edge 32 of the cover 12 assembled with interference on the first edge 23 of the base 11, the lower wall 35 of the edge 32 is overlapped to the lower wall 25 which connects the first edge 23 to the second edge 24 of the base 11 and ends next to the second edge 24, preferably next to the second internal wall 47; in this way, advantageously, the second edge 24 prevents the access to the lower wall 35 of the edge 32, preventing it from being lifted to open the cover 12 without removing the second edge 24 functioning as tamper evident.

Preferably, the base 11 further comprises a tongue 16 connected to the second edge 24 adapted to facilitate the grasp by a user to separate along the breaking line 26 the second tamper evident edge 24 from the first edge 23 and from the base 11 to allow opening the container 10 providing evidence of the occurred opening.

Figure 5:
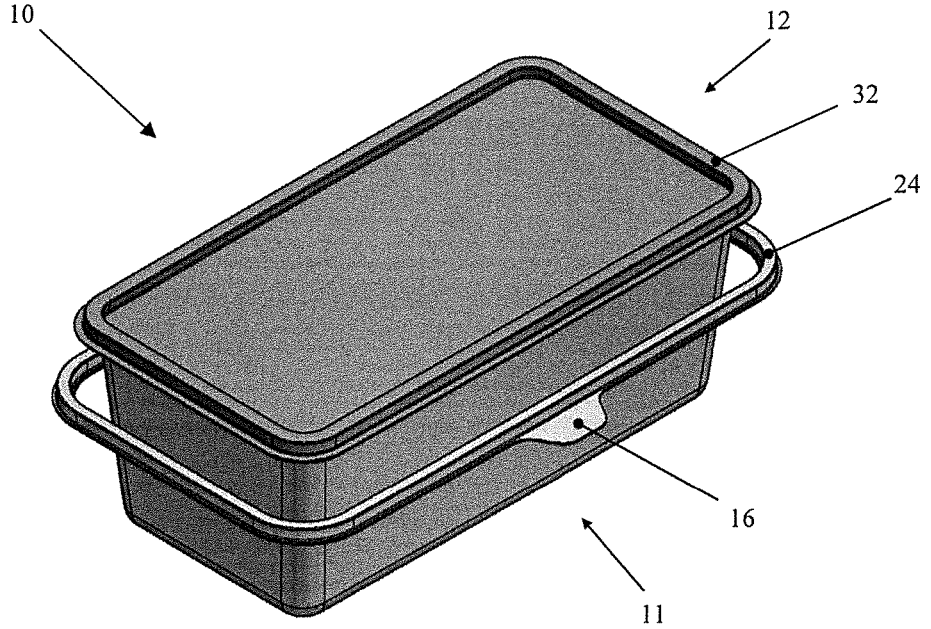
FIG. 5 is a perspective view of a first embodiment of a container according to the present invention with the tamper evident part removed.
Figure 6:
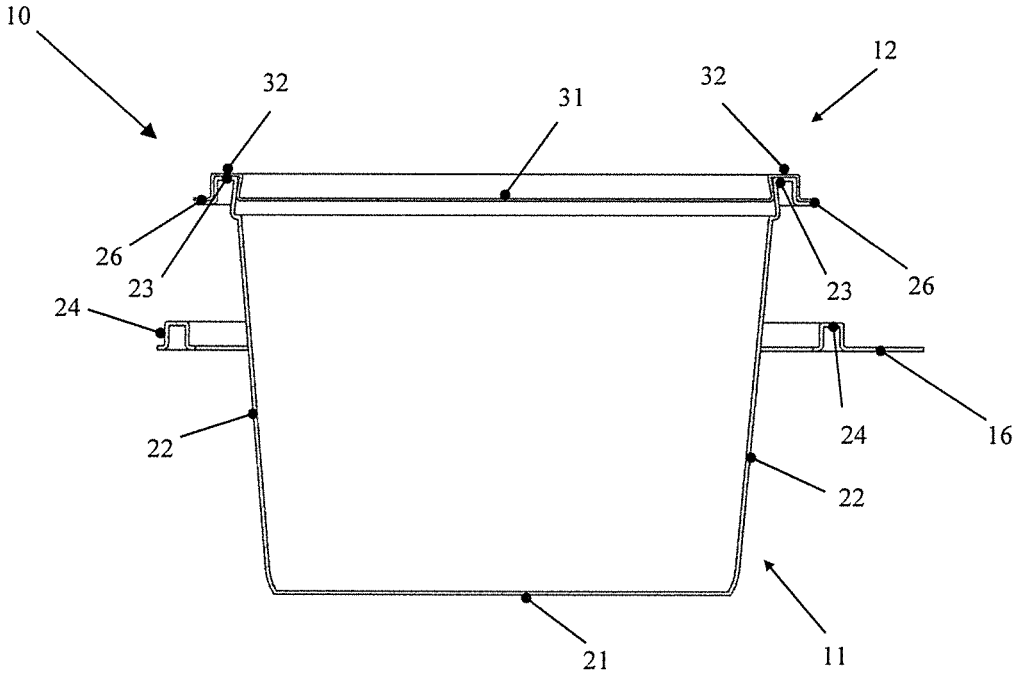
FIG. 6 is a side sectional view of a first embodiment of a container according to the present invention with the tamper evident part removed.

In a first embodiment of the container 10 according to the invention shown in FIGS. 5 and 6, the breaking line 26 is obtained along all the lower wall 25 which connects the first edge 23 to the second edge 24, which in turn are made around the whole profile of the mouth 15 of the base 11; in this way, in order to open the cover 12 by lifting the lower wall 35 of the edge 32, it is necessary to first remove the second edge 24 detaching it from the base 11, and in particular from the first edge 23, next to the breaking line 26 which is obtained along the whole lower wall 25, thereby allowing the complete removal of the second edge 24 from the base 11 of the container.

Once having removed the second edge 24 from the base 11 of the container, it is possible to access to the lower wall 35 of the edge 32, to lift it and open the cover 12.

Figure 7:
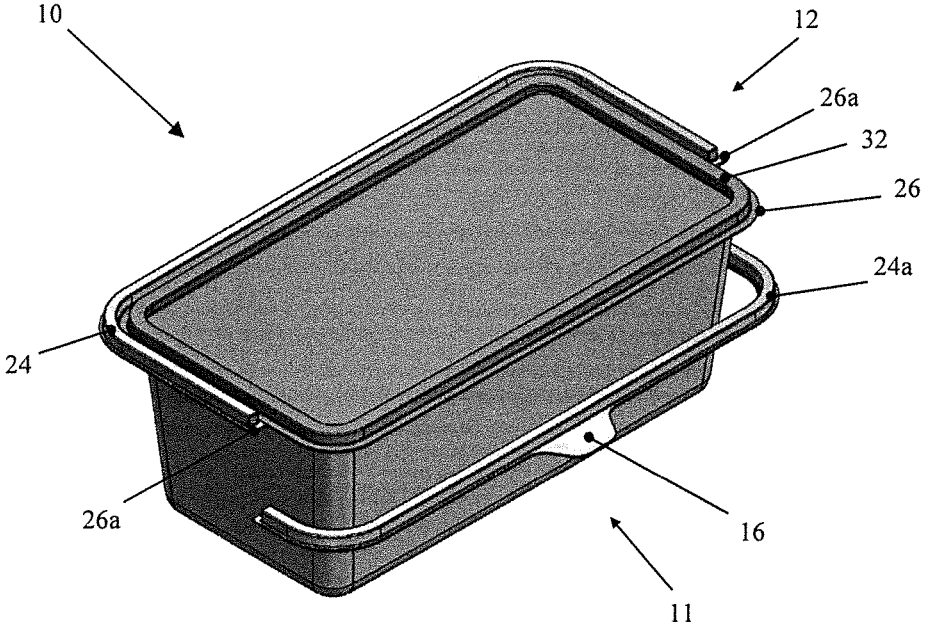
FIG. 7 is a perspective view of a second embodiment of a container according to the present invention with the tamper evident part removed.

In a second embodiment of the container 10 according to the invention shown in FIG. 7, the breaking line 26 is obtained only along a part of the lower wall 25 which connects the first edge 23 to the second edge 24, and goes on with second transverse breaking lines 26*a*, preferably perpendicular to the second edge 24, in order to separate only a part 24*a* of the second edge 24 from the base 11, while the rest of the second edge 24 remain connected to the base 11; in this way, in order to open the cover 12 by lifting the lower wall 35 of the edge 32, it is necessary to first remove the part 24*a* of the second edge 24 by detaching it from the base 11, and in particular from the first edge 23, next to the breaking lines 26 and 26*a* made along part of the lower wall 25 and perpendicular thereto, thereby allowing the removal of the part 24*a* of the second edge 24 from the base 11 of the container.

Once having removed the part 24*a* of the second edge 24 from the base 11 of the container, it is possible to access to the lower wall 35 of the edge 32, to lift it and open the cover 12.

Figure 8:
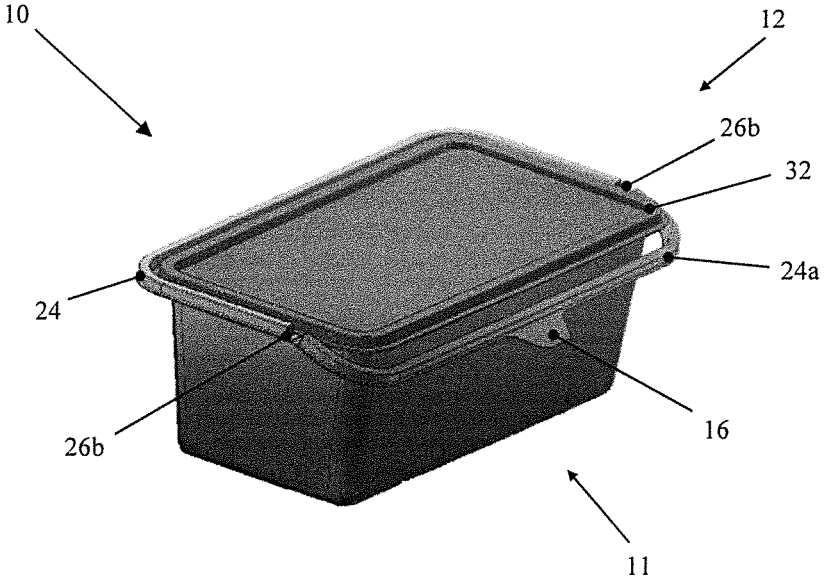
FIG. 8 is a perspective view of a third embodiment of a container according to the present invention with the tamper evident part bent.

In a third embodiment of the container 10 according to the invention shown in FIG. 8, the breaking line 26 is obtained only along a part of the lower wall 25 which connects the first edge 23 to the second edge 24, and goes on with transverse bending lines 26*b*, preferably perpendicular to the second edge 24, in order to separate only a part 24*a* of the second edge 24 from the base 11, which is bent along the bending lines 26*b* and remains attached to the other part of the second edge 24 which remains connected to the base 11; in this way, in order to open the cover 12 by lifting the lower wall 35 of the edge 32, it is necessary to detach the part 24*a* of the second edge 24 from the base 11, and in particular from the first edge 23, next to the breaking line 26 obtained along part of the lower wall 25 and afterwards bending it along the bending lines 26*b*, thereby allowing the partial removal of the part 24*a* of the second edge 24 from the base 11 of the container, keeping it attached to the rest of the second edge 24 next to the bending lines 26*b*.

Once the part 24*a* is separated from the base 11 of the container and is bent along the bending lines 26*b*, it is possible to access to the lower wall 35 of the edge 32, to lift it and open the cover 12.

Advantageously, the second edge 24 of the base 11 of the container 10 according to the invention, being next to the edge 32 when the cover 12 is closed on the base 11, prevents the access to the lower wall 35 of the edge 32 and prevents the cover 12 from being opened without removing the second tamper evident edge 24.

The invention claimed is:

1. A container comprising:

a base comprising a mouth, a first edge obtained around the mouth and a second edge connected to the first edge by a lower wall;

a cover capable of being closed again on the base, the cover comprising a base wall and an edge connected to the base wall and adapted to be assembled with interference on the first edge of the base; and the lower wall further comprising a breaking line along which the separation of the second edge from the first edge and from the base is adapted to occur, to allow opening the container providing evidence of the occurred opening, wherein the first edge comprises a first internal wall connected to a side wall of the base, a first external wall connected to the lower wall and a first upper wall connected to the first internal wall and to the first external wall, the second edge comprising a second internal wall connected to the lower wall, a second external wall and a second upper wall connected to the second internal wall and to the second external wall, the edge of the cover comprising an internal wall connected to the base wall of the cover, an external wall and an upper wall connected to the internal wall and to the external wall, the first upper wall of the first edge having sizes greater than those of an opening of the edge, to assemble with interference the first edge of the base inside the edge of the cover when the cover is closed on the base, and wherein the breaking line is obtained only along a part of the lower wall which connects the first edge to the second edge, and goes on with bending lines transverse to the second edge, in order to separate only a part of the second edge from the base, which is bent along the bending lines and remains attached to the other part of the second edge which remains connected to the base, allowing the partial removal of the part of the second edge from the base of the container, keeping it attached to the rest of the second edge next to the bending lines.

2. The container of claim 1, wherein the breaking line is obtained only along a part of the lower wall which connects the first edge to the second edge, and goes on with second breaking lines transverse to the second edge, in order to separate only a part of the second edge from the base, while the rest of the second edge remains connected to the base.

3. The container of claim 1, wherein the edge of the cover comprises a lower wall adapted to be assembled in contact with the lower wall which connects the first edge to the second edge when the cover is closed on the base so that the lower wall of the edge is overlapped to the lower wall which connects the first edge to the second edge of the base and ends next to the second edge to prevent an access to the lower wall of the edge without removing the second edge.

4. The container of claim 1, wherein the base further comprises a tongue connected to the second edge adapted to facilitate the grasp by a user to separate along the breaking line the second edge from the first edge and from the base to allow opening the container providing evidence of the occurred opening.

5. The container of claim 1, wherein the first edge and the second edge form two small channels around the mouth of the base, and the edge forms a small channel around the cover, the small channel formed by the first edge being adapted to be assembled with interference inside the small channel formed by the edge.

6. The container of claim 1, wherein the base comprises a base wall connected to at least one side wall, and the base wall has a polygonal, circular, or oval shape, and the container has substantially the shape of a parallelepiped or of a cylinder, or a circular or oval shape, the at least one side wall of the base being slanted or substantially perpendicular to the base wall.

* * * * *